US007275948B2

(12) United States Patent
Miura et al.

(10) Patent No.: US 7,275,948 B2
(45) Date of Patent: Oct. 2, 2007

(54) CONNECTOR

(75) Inventors: Kazuto Miura, Kanagawa (JP); Akihito Funakoshi, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/637,722

(22) Filed: Dec. 13, 2006

(65) Prior Publication Data

US 2007/0141897 A1 Jun. 21, 2007

(30) Foreign Application Priority Data

Dec. 16, 2005 (JP) ..... 2005-362781

(51) Int. Cl.
*H01R 13/15* (2006.01)

(52) U.S. Cl. ..... 439/260; 439/495

(58) Field of Classification Search ..... 439/260, 439/495, 492, 493, 499
See application file for complete search history.

(56) References Cited

U.S. PATENT DOCUMENTS

| | | | | |
|---|---|---|---|---|
| 6,099,346 | A * | 8/2000 | Hashiguchi et al. | 439/495 |
| 6,224,418 | B1 * | 5/2001 | Miura et al. | 439/495 |
| 6,305,971 | B1 * | 10/2001 | Yu-Feng | 439/493 |
| 6,394,838 | B1 * | 5/2002 | Yen | 439/492 |
| 6,551,128 | B2 * | 4/2003 | Asai | 439/495 |
| 6,726,497 | B2 * | 4/2004 | Nogawa et al. | 439/260 |
| 6,837,740 | B2 * | 1/2005 | Kunishi et al. | 439/495 |
| 7,063,559 | B2 * | 6/2006 | Wang et al. | 439/495 |
| 7,086,884 | B2 * | 8/2006 | Okano | 439/260 |
| 7,112,079 | B2 * | 9/2006 | Miura et al. | 439/260 |
| 7,137,838 | B2 * | 11/2006 | Koga | 439/260 |
| 7,168,976 | B1 * | 1/2007 | Huang | 439/495 |
| 7,172,446 | B1 * | 2/2007 | Hashimoto et al. | 439/260 |
| 7,214,081 | B1 * | 5/2007 | Ju | 439/260 |
| 2002/0045374 | A1 * | 4/2002 | Kunishi et al. | 439/260 |
| 2002/0081884 | A1 * | 6/2002 | Asai | 439/260 |
| 2002/0115327 | A1 * | 8/2002 | Yamane | 439/260 |
| 2003/0157829 | A1 * | 8/2003 | Kunishi et al. | 439/495 |
| 2005/0118849 | A1 * | 6/2005 | Okita et al. | 439/260 |
| 2005/0255732 | A1 * | 11/2005 | Sunaga | 439/260 |
| 2006/0089036 | A1 * | 4/2006 | Takai et al. | 439/260 |

(Continued)

FOREIGN PATENT DOCUMENTS

| | | |
|---|---|---|
| JP | 11-185896 A | 7/1999 |

(Continued)

*Primary Examiner*—Ross Gushi
(74) *Attorney, Agent, or Firm*—Rader, Fishman & Grauer PLLC

(57) ABSTRACT

A connector of upper contact type for an FPC comprising a cover housing constituted of synthetic resin alone. The housing includes first contacts and second contacts alternately arranged in parallel on a line. Each of the first contacts has an elastic arm coming into contact with an upper contact point of FPC when the cover housing is closed. On the other hand, each of the second contacts has a tuning-fork-shaped contact constituted of a pair of a short arm and a long arm, the short arm coming into contact with the upper contact point of the FPC so that the tuning-fork-shaped contact may exert a coupled force on the FPC when the cover housing is closed. With such a configuration, this connector reduces deformation of the cover housing while eliminating use of any reinforcing metal member in the cover housing.

16 Claims, 10 Drawing Sheets

U.S. PATENT DOCUMENTS

| | | | | |
|---|---|---|---|---|
| 2006/0110965 | A1* | 5/2006 | Koga | 439/260 |
| 2006/0141837 | A1* | 6/2006 | Okano | 439/260 |
| 2006/0178039 | A1* | 8/2006 | Chen | 439/495 |
| 2006/0286843 | A1* | 12/2006 | Fukazawa | 439/260 |
| 2007/0049087 | A1* | 3/2007 | Hashimoto et al. | 439/260 |
| 2007/0054529 | A1* | 3/2007 | Harlan et al. | 439/260 |
| 2007/0054545 | A1* | 3/2007 | Takahira | 439/495 |
| 2007/0066127 | A1* | 3/2007 | Inoue | 439/495 |
| 2007/0087605 | A1* | 4/2007 | Suzuki et al. | 439/260 |

FOREIGN PATENT DOCUMENTS

| | | | |
|---|---|---|---|
| JP | 11-260443 | A | 9/1999 |
| JP | 2001-126793 | A | 5/2001 |
| JP | 2003-109695 | A | 4/2003 |
| JP | 2003-178831 | A | 6/2003 |
| JP | 2004-127693 | A | 4/2004 |
| JP | 2004-235136 | A | 8/2004 |
| JP | 2004-319349 | A | 11/2004 |
| JP | 2004-335551 | A | 11/2004 |
| JP | 2005-78842 | A | 3/2005 |
| JP | 2005-142144 | A | 6/2005 |
| JP | 2005-158508 | A | 6/2005 |

* cited by examiner

PRIOR ART

PRIOR ART

CONNECTOR

This application is based on and claims the benefit of priority from Japanese Patent Application No. 2005-362781, filed on Dec. 16, 2005, the content of which is incorporated herein by reference.

BACKGROUND OF THE INVENTION

1. Field of the Invention

The present invention relates to a connector to be connected with a flat flexible cable such as an FPC (Flexible Printed Circuit) and an FFC (Flexible Flat Cable), which are generically called FPC in this specification, and particularly to a ZIF (Zero Insertion Force) type connector for a FPC which requires little force for insertion and removal of the FPC.

2. Related Art

A connector for an FPC to be surface-mounted on a printed circuit board, or a surface mount connector for an FPC has an insulated housing formed with an insertion portion for inserting the FPC and a plurality of contacts fitted onto the housing side by side in a line at predetermined pitches. To bring the FPC into touch with the contacts, for example, an opening and closing cover housing is provided at the insertion portion.

As such a connector for an FPC, there has been invented a connector for an FPC capable of attaining a stable pressing force against the FPC by increasing the strength of a cover housing pressing a plurality of contacts against the FPC and capable of being connected whether the conductor pattern of the FPC is in an upward or downward position. (For example, refer to Patent Documents 1 below.)

Furthermore, as such a connector for FPC, there has been also invented an upper contact type connector for an FPC capable of ensuring sufficient contact pressure against the FPC by preventing the contacts from being excessively deformed. (For example, refer to Patent Document 2 below.)

Patent Document 1: Japanese Unexamined Patent Application Publication No. Hei 11-185896

Patent Document 2: Japanese Unexamined Patent Application Publication No. 2001-126793

FIG. 13 is a longitudinal sectional view of a connector for an FPC according to Patent Document 1 illustrating a constitutional view including an FPC with a cover housing in an open position. FIG. 13 used herein corresponds to FIG. 4 in Patent Document 1.

As shown in FIG. 13, a connector 8 includes a housing 82, a plurality of contacts 83, a cover housing 84 and a plurality of cover contacts 820. The housing 82 is formed with an opening 87 open upwards. The plurality of contacts 83 are stored and retained in the housing 82 at regular pitches, and a contact portion 817 of an elastic contact beam 814 is disposed at the opening 87. The plurality of contacts 83 includes an arm 815 and an elastic contact beam 814, and the arm 815 is formed integrally with the elastic contact beam 814. The arm 815 extends to the opening 87 along an upper wall 86 of the housing 82, and the front end thereof is formed with a pivotal support portion 818. The pivotal support portion 818 faces the contact portion 817.

As shown in FIG. 13, the cover housing 84 is supported, engaged with the pivotal support portion 818 and moves between a pressure position in proximity to the contact portion 817 and an open position separated from the contact portion 817. When the cover housing 84 is moved toward a pressure position, FPC 1 disposed on the elastic contact beam 814 is pressed against the elastic contact beam 814. The plurality of cover contacts 820 are arranged on the inside of the cover housing 84, corresponding to the contacts 83, and are engaged with the pivotal support portion 818. The plurality of cover contacts 820 are pressed against FPC 1 for contact at a pressurizing position, and comes into contact with the pivotal support portion 818 for electrical continuity.

FIGS. 14A and 14B are longitudinal sectional views of a connector for an FPC according to Patent Document 2, and FIG. 14A is a longitudinal sectional view of the whole connector and FIG. 14B is an enlarged view of the principal part of FIG. 14A. FIGS. 14A and 14B used herein corresponds to FIG. 5 of Patent Document 2.

As shown in FIGS. 14A and 14B, a connector 9 includes a housing 94, a plurality of tuning-fork-shaped contacts 923 and a cover housing 97. A housing 94 is formed with an opening 96 open upwards. A plurality of contacts 923 are arranged so as to face the opening 96 in the housing 94. The contacts 923 includes an elastic piece 935 positioned on the upper side and a stationary piece 933 positioned on the lower side, the elastic piece 935 and the stationary piece 933 facing each other. The cover housing 97 is pivotally supported by the pivotal support portion (not shown) of the housing 94 or a member retained on the housing 94, and opens or closes the opening 96 with rotation thereof.

As shown in FIG. 14A or 14B, the free end of the elastic piece 935 has an upper branch piece 939 and a lower branch piece 941 branching in a roughly C shape. The lower branch piece 941 includes a contact 948 coming into pressure contact with FPC 1. One end of the cover housing 97 is disposed between the upper branch piece 939 and the lower branch piece 941 to regulate a displacement range of the elastic piece 935. The one end of the cover housing 97 includes a cam surface 959 pushing up the upper branch piece 939 so as to expand an insertion space 93 for FPC 1 below the contact 948.

As shown in FIG. 13, the cover contact 820 is produced by punching a metal sheet in the same way as for the contact 83 and is formed integrally with the cover housing 84 by means of insert molding at the time of forming the synthetic resin cover housing 84.

As shown in FIG. 14A or 14B, a pair of pivotal spindles (not shown) having a pivotal axial line A1 is provided on both ends of a metal wire 945 embedded in the cover housing 97. Moreover, a metal reinforcing wire 951 is embedded in the cover housing 97. To insert the metal wires 945, 951 into the synthetic resin cover housing 97 at the time of forming them into the synthetic resin cover housing 97 and embed them into a molded product of the cover housing 97, the metal wires 945, 951 are supported at a predetermined position within a metallic mold.

A connector for the FPC which has a FPC conductor pattern facing upwards or which is of an upper contact type, as shown in Patent Documents 1 and 2, prevents deformation of the cover housing by insert molding (integrally forming) a metal member into the synthetic resin cover housing.

However, such integrally molded products including metal members cause higher costs in production than molded products made of synthetic resin alone. As a matter of course, an increase in the number of components causes higher costs. This is because supporting a metal member in a predetermined position within a metal mold requires much production time per product and causes difficulty in simultaneously forming a plurality of products. An increase in the cost of a cover housing leads to a higher cost of the connector for an FPC.

Attainment of a molded cover housing made of synthetic resin alone by devising a structure of an upper contact type connector for an FPC can reduce the production cost of the connector. As a connector for an FPC having the multi-pin contacts and narrow pitches, a connector for FPC is required which has a structure capable of completely maintaining an open/closed position without deforming the cover housing. These are problems addressed by the present invention.

SUMMARY OF THE INVENTION

In view of the aforementioned problems, it is an object of the present invention to provide a connector for an FPC having a structure capable of performing complete switching without deforming a cover housing made of synthetic resin alone, for an upper contact type connector for an FPC having multi-pin contacts and small pitches.

The inventors of the present invention have invented the following new connector for an FPC employing a structure in which a housing accommodates first contacts and second contacts alternately arranged in parallel on a line, each of the first contacts having an elastic arm coming into contact with an upper contact point of an FPC when a cover housing is closed and each of the second contacts having a tuning-fork-shaped contact formed out of a pair of a long arm and a short arm coming into contact with an upper contact point of an FPC so that the tuning-fork-shaped contact may apply a coupled force to the FPC.

In a first aspect of the connector, a connector including a housing, a cover housing and a plurality of first contacts and second contacts, the housing being roughly rectangular parallelepiped in shape and having a recess formed for insertion of an FPC, the cover housing being roughly rectangular in shape for openably and closably covering the recess of the housing and the first contacts and second contacts being alternately arranged in parallel on a line inside the housing, in which each of the first contacts includes a first fixing arm and a first horizontal arm opposing each other, a first connection leg for connecting base ends of the first fixing arm and the first horizontal arm to each other, a first pressing portion provided on the tip side of the first horizontal arm and opposing the bottom surface of the recess, an elastic arm extending between the first fixing arm and the first horizontal arm and opposing the first horizontal arm, and a first contact point provided on the tip side of the elastic arm and opposing the bottom surface of the recess; each of the second contacts includes a second fixing arm and a second horizontal arm opposing each other, a second connection leg for connecting base ends of the second fixing arm and the second horizontal arm to each other, a second pressing portion provided on the tip side of the second horizontal arm and opposing a bottom surface of the recess, a short arm and a long arm extending between the second fixing arm and the second horizontal arm and opposing each other, a second contact point provided on the tip side of the short arm and positioned near the opposite side to an opening in the recess opposing the bottom surface of the recess, and a protrusion provided on the tip side of the long arm and positioned near the opening in the recess, protruding toward the direction of the top face of the recess; and the cover housing includes a cam portion positioned between the first pressing portion and the tip of the elastic arm and pressed by the first pressing portion, and an engaging portion positioned between the second pressing portion and the bottom surface of the recess and engaging with the second pressing portion.

According to the first aspect of the connector, the connector includes a roughly rectangular parallelepiped housing, a roughly rectangular plate-shaped cover housing and a plurality of first contacts and second contacts. The housing is formed with a recess for inserting an FPC. The cover housing covers the recess so as to permit opening and closing. The plurality of first contacts and second contacts are alternately arranged in parallel on a line inside the housing.

Generally, an FPC is bonded with copper foil serving as a conductor pattern on a base film formed out of insulated polyester or polyimide. The conductor pattern is covered with an insulating film, and one end of the FPC has an exposed conductor pattern for conductive contact with the contacts provided on the connector. The FPC applied to the connector of the present invention is an FPC one side of which has a conductive pattern provided on a single side of a base film, and the end of the one-sided FPC has an exposed conductor pattern on a single side of the base film. The conductive pattern of the one-sided FPC is inserted into the recess so as to become an upward or upper contact point.

The housing has insulation properties. The insulating housing is a housing made of non-conductive material. For example, by molding a synthetic resin material, a desired shape of an insulating housing can be attained. Similarly, the cover housing has insulating properties. By molding a synthetic resin material, a desired shape of an insulating cover housing can be attained. As the housing and the cover housing, an insulator of the same or different material may be used.

The housing is formed with, for example, a thin rectangular parallelepiped recess for inserting an FPC. The FPC is inserted toward an insertion portion from an opening side of the recess on the housing. In inserting the FPC into the recess of the housing, for example, a pair of opposed standing walls forming the recess of the housing regulate the cross direction of the FPC and are positioned to match the position of the plurality of first contacts and second contacts.

The insertion portion is formed with a stopping wall with which the FPC end is brought into contact. Since the plurality of first contacts and second contacts are pressed in the housing, the stopping wall is formed in the shape of comb's teeth.

For the FPC to be diagonally inserted at a predetermined open angle to the bottom surface of the recess, the insertion portion may be formed so as to be slightly larger than the thickness of the FPC and so that a surface facing the bottom face of the recessed portion is slanting. This connector is a ZIF connector which hardly requires little force to insert and remove the FPC into/from the insertion portion.

For example, in the cover housing, a pivot shaft both ends of which are pivotally supported on the housing is mounted on one end and the other end of the cover housing opens and closes the opening of the recess. A pair of columnar protrusions coaxial to the pivot shaft may be disposed on both sides of the one end of the cover housing and are pivotally supported at both ends thereof on the housing. A pair of support members (for example, a pair of tabs described later) pressed in the housing may be constructed to pivotally support the pair of columnar protrusions.

The description "the cover housing covers the recess in a way capable of opening and closing" means to that the cover housing that covers the recess is opened to have the FPC inserted therein, and that the cover housing closes to cover the recess so that the cover housing presses the FPC toward the bottom surface of the recess, resulting in a conductive contact of first to second contacts with the FPC. The connector may be provided with a locking mechanism in order to maintain the cover housing in the closed position when the cover housing is closed.

The first and second contacts have conductive properties. The conductive contact is a contact made of a material having a low resistivity, and the first and second contacts can achieve a desired shape, for example, by precise punching of a metal thin plate made of copper alloy. A contact formed out of a metal plate is sometimes referred to as a planar contact.

In the housing, for example, a plurality of longitudinal rectangular grooves are formed in the shape of the teeth of a comb from the opening of the recess to the insertion portion and further in a rear direction of the insertion portion. The first contact is pressed into the longitudinal rectangular grooves from the opening of the recess. In the housing, on the other hand, a plurality of longitudinal rectangular grooves are formed in the shape of comb-teeth from the opposite side to the opening of the recess toward the opening. The second contact is pressed into the longitudinal rectangular grooves.

The longitudinal rectangular groove has a width slightly larger than the plate thickness of the first contact and the second contact so that the elastic arm, the short arm and the long arm described later cannot avoid becoming deflected. The first contact and the second contact may have an equal plate thickness, and the longitudinal rectangular grooves may have an equal width. It can be said that the first contact and the second contact in the upper and lower direction respectively are pressed into the housing so as to come into contact with the top surface and the bottom surface respectively of the recess of the housing.

The words "parallel arrangement" or "arranged in parallel" described herein mean that the contacts are adjacent to each other and aligned in a line. The interval may be equal to the interval of the conductive pattern of the FPC (the conductive pattern disposed at an end of the FPC).

The connector according to the first aspect of the present invention described above is constructed so that the first and the second contacts include a fixing arm and a horizontal arm opposing each other. Moreover, the first and the second contacts include a connection leg having one end connecting to the fixing arm and the other end connecting to the horizontal arm.

The first contact has an elastic arm which extends between the fixing arm and the horizontal arm of the first contact and opposes the horizontal arm. The elastic arm extends in a direction substantially parallel to the fixing arm. The second contact has a short arm and a long arm which extends between the fixing arm and the horizontal arm of the second contact and opposes with each other. The short arm and the long arm strictly have no linear contour, however, extend in a direction substantially parallel to the fixing arm.

The horizontal arms of the first contact and the second contact have a pressing portion opposing the bottom surface of the recess. The elastic arm has a first contact point opposing the bottom surface of the recess on the tip side thereof. The short arm has the second contact point positioned near the back of the recess, or the opposite side to the opening of the recess on the tip side thereof. The short arm facing the bottom surface of the recess, in other words, facing downwards. The long arm has a protrusion protruding upwards on the tip side thereof. In this specification, "downwards" means a direction which is the bottom surface of the recess, and "upwards" means a direction which is the top face of the recess with which the cover housing is connected.

For example, the first contact includes the connection leg with one end of the fixing arm standingly provided, and the horizontal arm is extendedly branched. Moreover, a pressing portion opposing the bottom surface of the recess is provided on the tip side of the horizontal arm. Preferably, the horizontal arm of the first contact is a rigid arm with a higher second moment of area than that of the second contact. The elastic arm is extendedly branched from the connection leg between the fixing arm and the horizontal arm of the first contact. The elastic arm has the first contact point facing downwards, opposing the bottom surface of the recess on the tip side thereof and, between the first contact point and the fixing arm arranged in the bottom surface of the recess, the FPC is inserted. The elastic arm has a function of spring that serves as a so-called cantilever contact.

The second contact includes a connection leg with one end of the fixing arm standingly provided, and the horizontal arm is extendedly branched toward the opening side of the recess from the connection leg. In addition, the pressing portion opposing the bottom surface of the recess is provided on the tip side of the horizontal arm. Preferably, the horizontal arm of the second contact is a rigid arm with a smaller second moment of area than that of the first contact. The short arm and the long arm opposing each other extend between the fixing arm and the horizontal arm of the second contact. The short arm has the second contact point facing downwards on the tip side thereof. The FPC is inserted between the second contact point and the long arm arranged in the bottom surface of the recess. The short arm has a function of a spring that serves as a so-called cantilever contact.

The length from the base end to the tip of the short arm is shorter than that of the long arm and as described later, the base ends of the short arm and the long arm are connected to each other through a connecting portion, thereby providing a constitution of an uneven length constituting a pair of the short arm and the long arm, that is, a tuning-fork-shaped contact. Positioning the second contact point of the short arm near the back of the recess, or the opposite side to the opening of the recess and positioning the protrusion of the long arm near the opening of the recess means that the second contact point and the protrusion are spaced apart from each other at a predetermined interval. Moreover, the FPC can be inserted in between the second contact point and the protrusion. The protrusion is biased so as to push up the FPC.

According to the first aspect of the connector described above is structured so that the cover housing has the cam portion and the engaging portion. The cam portion is positioned between the pressing portion of the first contact and the tip end of the elastic arm and is pressed against the pressing portion of the first contact. The engaging portion is positioned between the pressing portion of the second contact and a protrusion described later, which is a tip of the long arm in the bottom surface of the recess, and is engaged with the pressing portion of the second contact.

The cam portion, formed around the pivot shaft, may be a plate cam having a plane curve as its contour, or an eccentric cam having a portion of the contour deviated from the center axis of the pivot shaft. Moreover, the tip side of the elastic arm is a follower displaced by a pivotal movement of the cam portion.

For example, as described later, the cam portion has a first contour portion and the second contour portion continuous to the first contour. When the first contour portion abuts against the pressing portion of the first contact, the cam portion is biased by a strong force from the tip side of the elastic arm to keep the cover housing closed. On the other hand, when the second contour portion abuts against the pressing portion of the first contact, the cam portion is biased by a weak force from the tip side of the elastic arm to keep the cover housing open.

When the FPC is inserted into the recess and the cover housing is closed, the cam portion pivots, so that the tip side of the elastic arm is displaced and a plurality of contact points of the first contact come into contact with a conductive pattern of the FPC for electrical continuity. When the cover housing is closed, a plurality of second contact points of the second contact come into contact with a conductive pattern of the FPC for electrical continuity. Specifically, when the cover housing is closed, the plurality of first contact points of the first contact push down the FPC to the bottom surface side of the recess. Also, a plurality of protrusions of the second contact protruding toward the top surface of the recess are pushed down to the bottom surface side of the recess. The short arm and the long arm becomes integrated into one body, which pivots around the base ends of the short arm and the long arm. In other words, the tuning-fork-shaped contact as the pair of the short arm and the long arm works so as to apply a couple of force to the FPC. The plurality of second contact points generate a couple of force toward the end of the FPC. The plurality of second contact points come into contact with the conductive pattern of the FPC, thus enabling electrical continuity.

When the cover housing is closed, a uniformly distributed load to be separated from the bottom surface of the recess is made to work on the cover housing by a reaction of the tip side of the elastic arm. In other words, a force which generates curving so as to separate from the bottom surface of the recess is made to work on the cover housing. The pressing portions of the plurality of first and second contacts exert a force moving toward the bottom surface of the recess to the cam portion and the engaging portion so as to resist a uniformly distributed load separated from the bottom surface of the recess.

A connector in the conventional art has a proportional relationship to the number of contacts, and applies a proportional force for deforming a cover housing. Accordingly, a multi-pin connector has an integrally-formed metal member for reinforcement to prevent deformation of the cover housing. On the other hand, the connector according to the first aspect described above does not receive a strong force deforming the cover housing from the second contact. In other words, it can be said that the force of deforming the cover housing is half the number of contacts. A well-balanced design of the reaction of the elastic arm and the drag of the pressing portion of the second contact can allow the cover housing to be a molded product made of synthetic resin alone.

For example, the number of poles of the contacts in the connector is 51 and the contact pitch is 0.3 mm. The connector according to the invention first aspect, as a connector for an FPC of an upper contact type with a small pitch, provides a connector for FPC having a structure capable of performing complete switching without deforming the cover housing made of synthetic resin alone.

According to the second aspect of the connector as described in the first aspect of the present invention, the horizontal arm of the first contact is a rigid arm having a larger geometrical moment of inertia than that of the second contact.

The tip of the horizontal arm of the first contact has a pressing portion opposing the bottom surface of the recess and, when the cover housing is closed, receives a reaction separated from the bottom surface of the recess from the elastic arm through a cam portion. To ensure that the plurality of cam portions are not curved by the reaction received as a uniformly distributed load, the horizontal arm of the first contact is a rigid arm with a higher geometrical moment of inertia than that of the second contact.

According to the third aspect of the connector as described in the first or the second aspect of the present invention, the cam portion includes a first contour portion for maintaining a closed position of the cover housing, and a second contour portion which is continuous with the first contour portion and maintains an open position of the cover housing, the cam portion biases the first contact point to the FPC when the pressing portion of the first contact engages with the second contour portion.

According to the fourth aspect of the connector as described in the first through three aspect of the present invention, the first contact point is positioned nearer to the opening side of the recess than the second contact point.

According to the fifth aspect of the connector as described in the first through fourth aspect of the present invention, wherein the base ends of the short arm and the long arm are connected to each other and the base end of the long arm is standingly extended from the fixing arm of the second contact.

According to the sixth aspect of the connector as described in the first through fifth aspect of the invention, the first contact includes a first lead portion extending in a non-insertion direction of FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

The connector provides a connector for a printed circuit board surface-mounted onto the printed circuit board by soldering the plurality of first and second lead portions to the printed circuit board. Furthermore, the first lead portion and the second lead portion are disposed in an opposing direction, therefore, a pitch between patterns connected to the first and second lead portions can be increased more than the case of the first and second lead portions extending in the same direction. This connector is effective, especially, for the case where the pitch of contacts is small or approximately 0.3 mm.

The connector according to the present invention, as a connector for an FPC of an upper contact type with a small pitch, provides a connector for an FPC having a structure capable of performing complete switching without deforming the cover housing made of synthetic resin alone.

DETAILED DESCRIPTION OF THE INVENTION

With reference to the drawings, the best mode for carrying out the invention will be described hereinafter.

Figure 1:
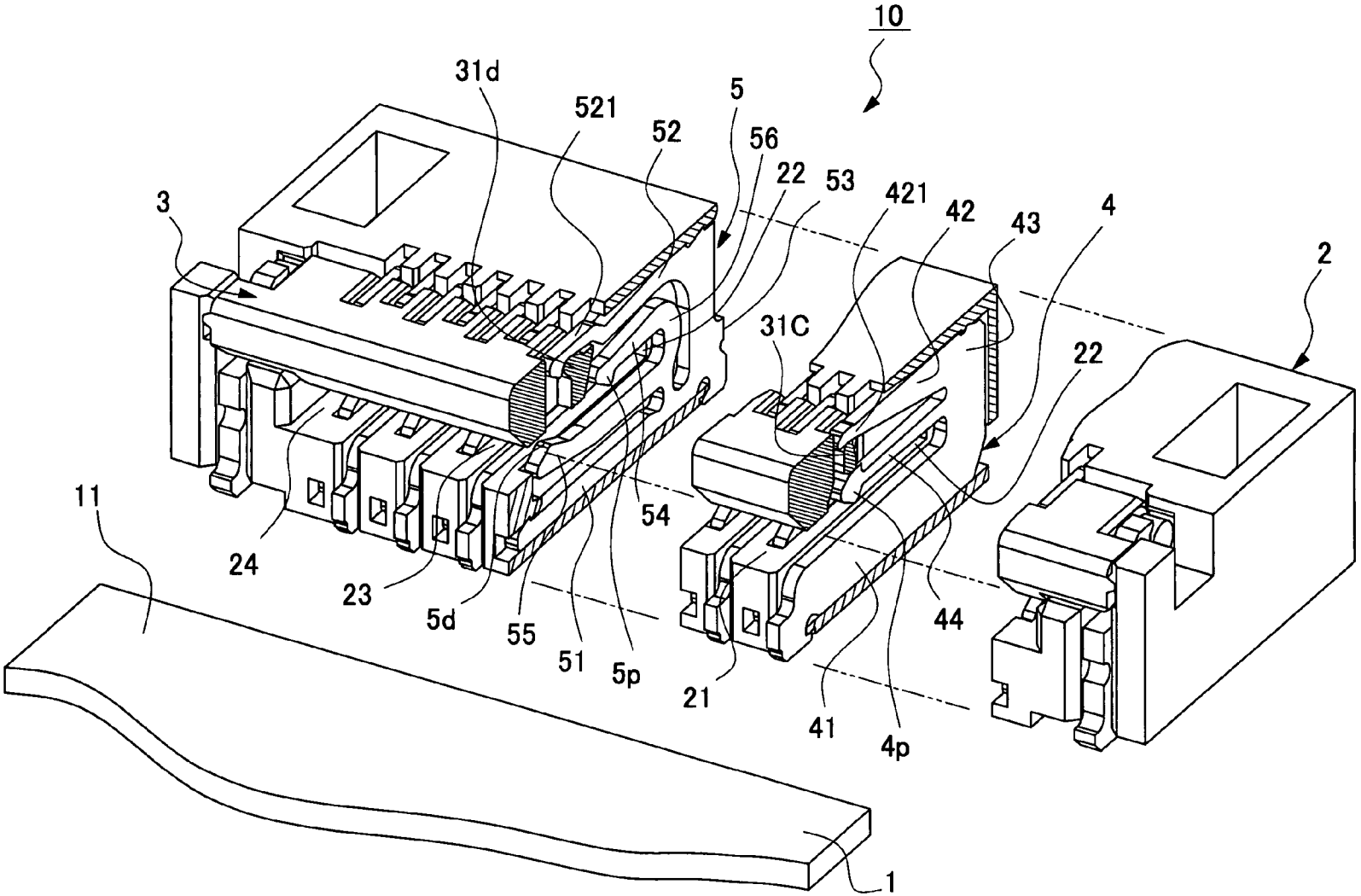
FIG. 1 shows a perspective outline view showing an embodiment of a connector for an FPC, in which the principal part is cross-sectionally illustrated.
Figure 2:
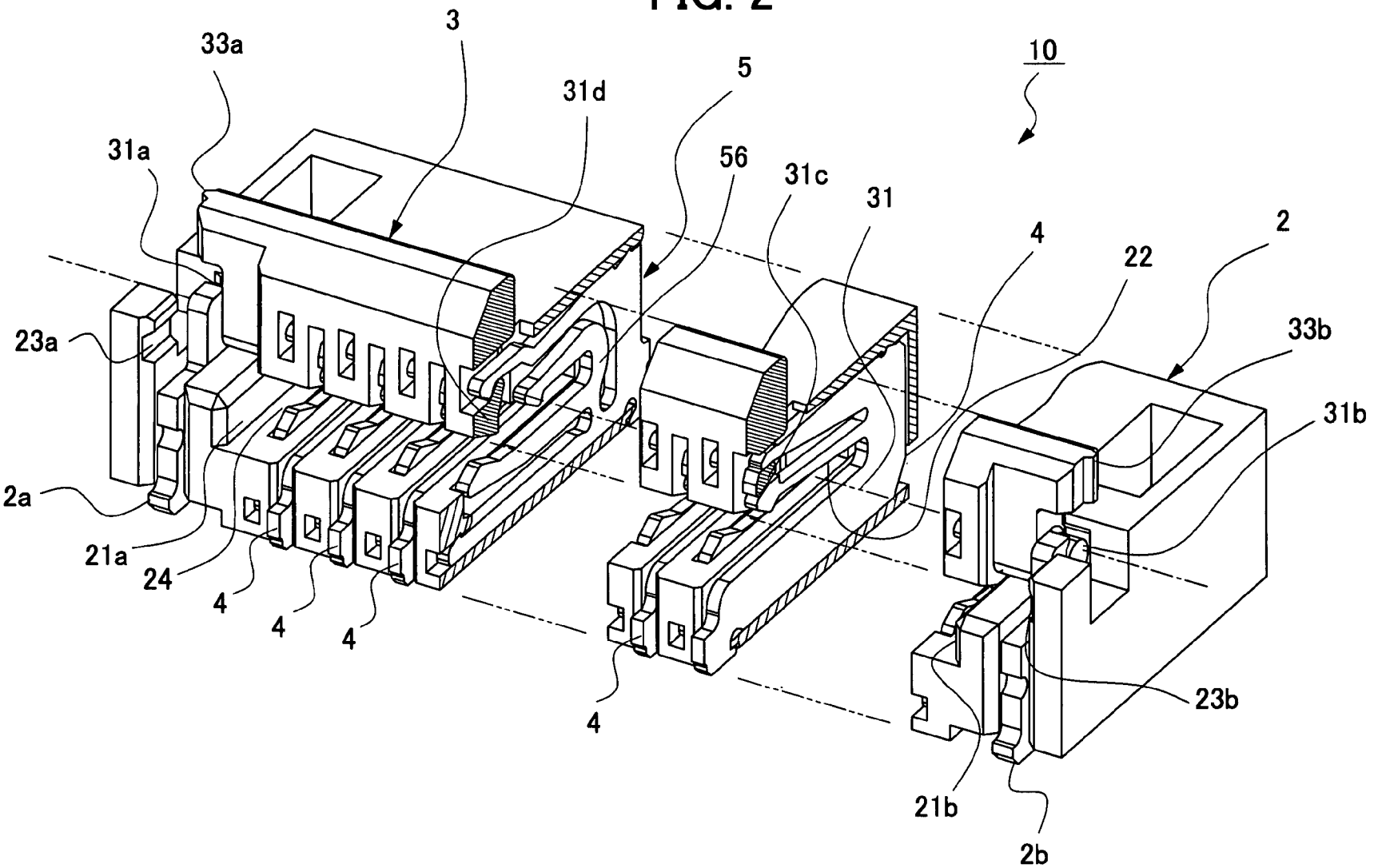
FIG. 2 shows a perspective outline view of a connector for FPC according to the present invention, in a state where the cover housing is opened.
Figure 3:
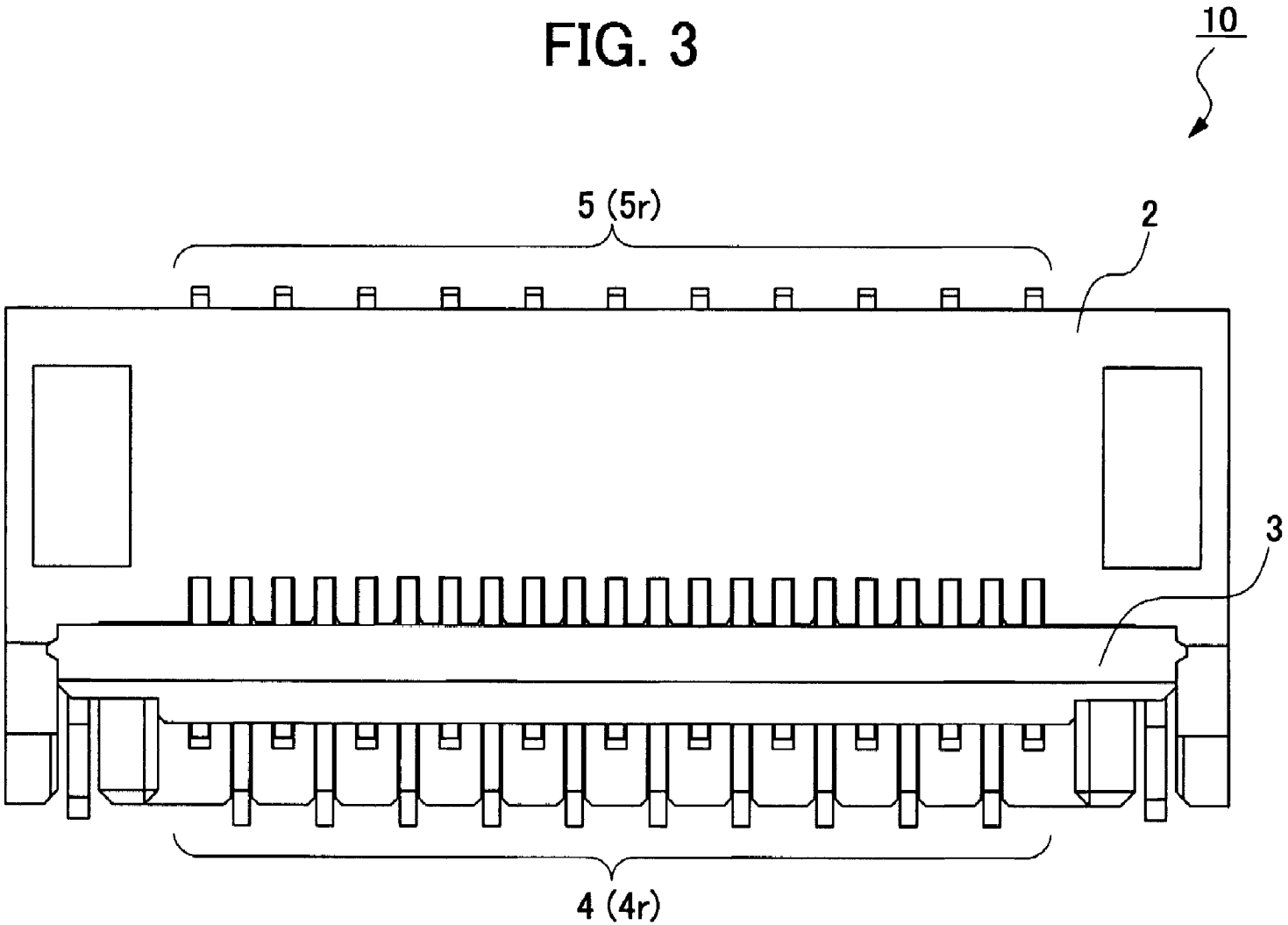
FIG. 3 shows a plan view of a connector for an FPC according to the present invention.
Figure 4:
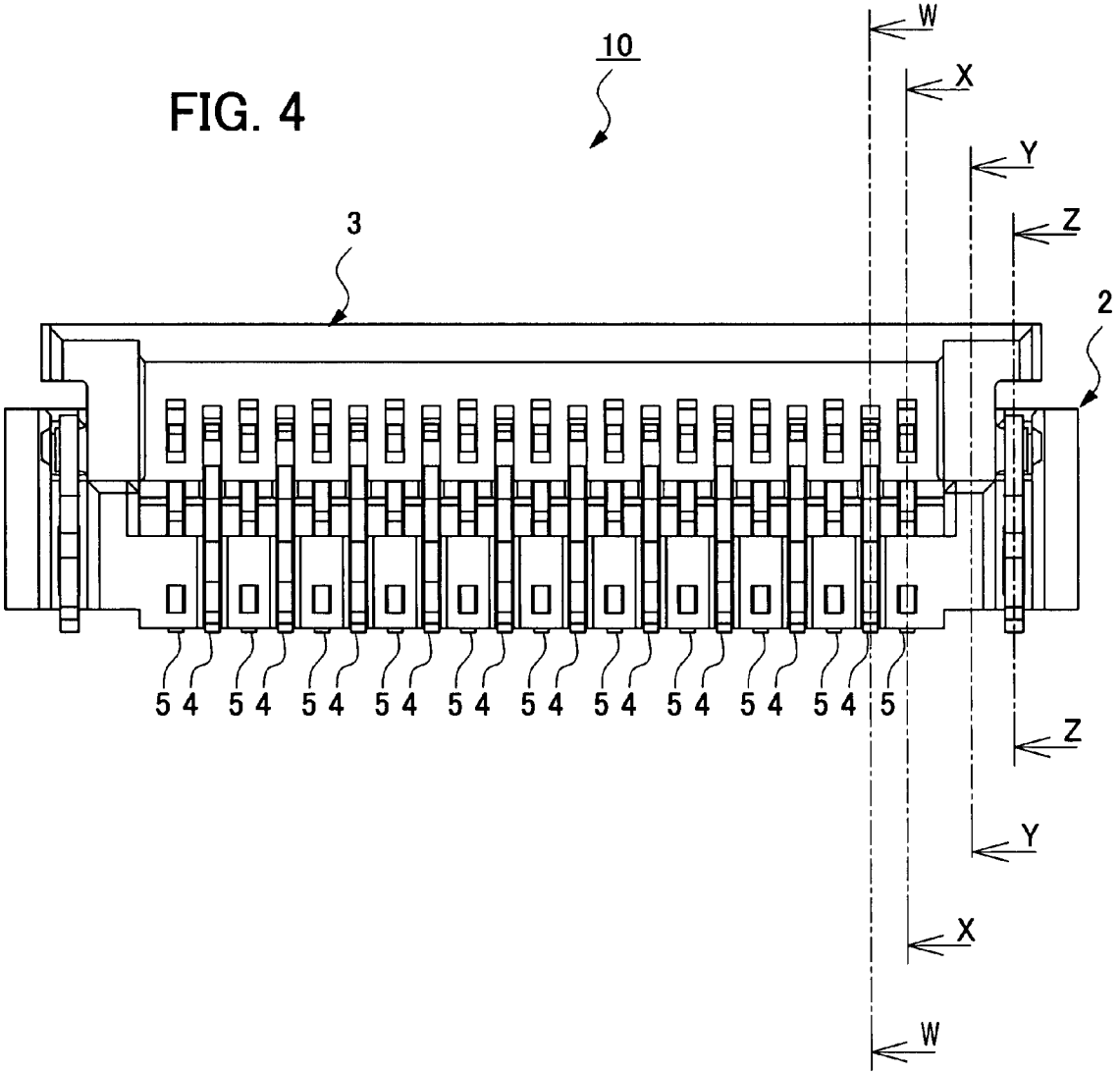
FIG. 4 shows a front view of a connector for an FPC according to the present invention.

FIG. 1 is a perspective outline view showing an embodiment of a connector for an FPC, hereinafter referred to as a connector, according to the present invention. FIG. 1 is a state view of a closed cover housing in which the principal parts are cross-sectionally shown. FIG. 2 is a perspective outline view of a connector according to the present invention, in a state where the cover housing is open. FIG. 3 is a plan view of a connector according to the present invention, in a state where the cover housing is open. FIG. 4 is a front view of a connector according to the present invention, in a state where the cover housing is open.

Figure 5:
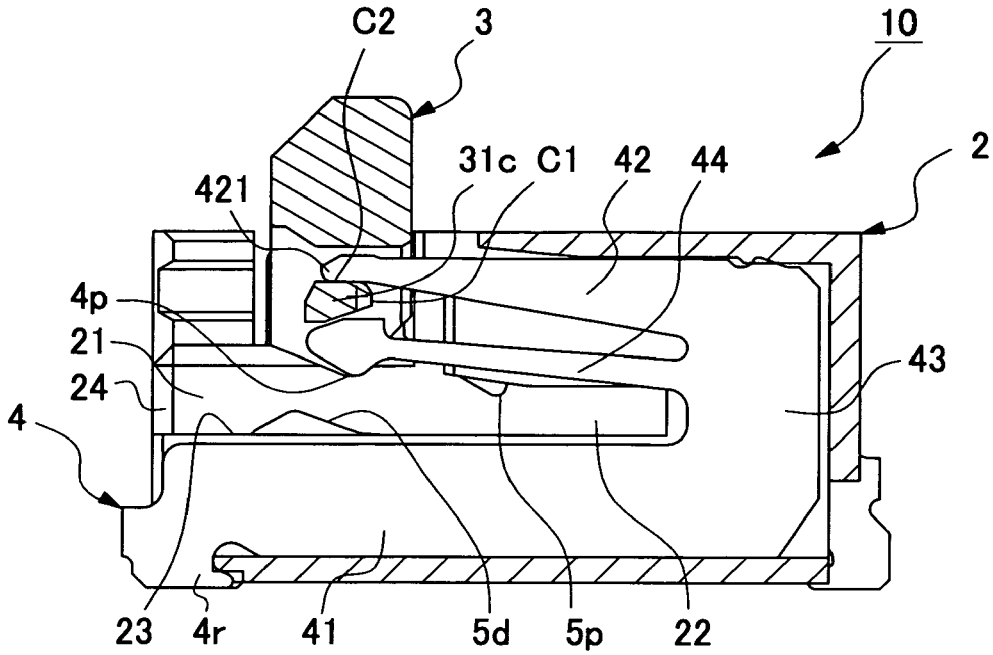
FIG. 5 shows a longitudinal sectional view in which the side surface of the first contact of a connector for FPC according to the present embodiment is cross-sectionally shown, in a state where the cover housing is open.
Figure 6:
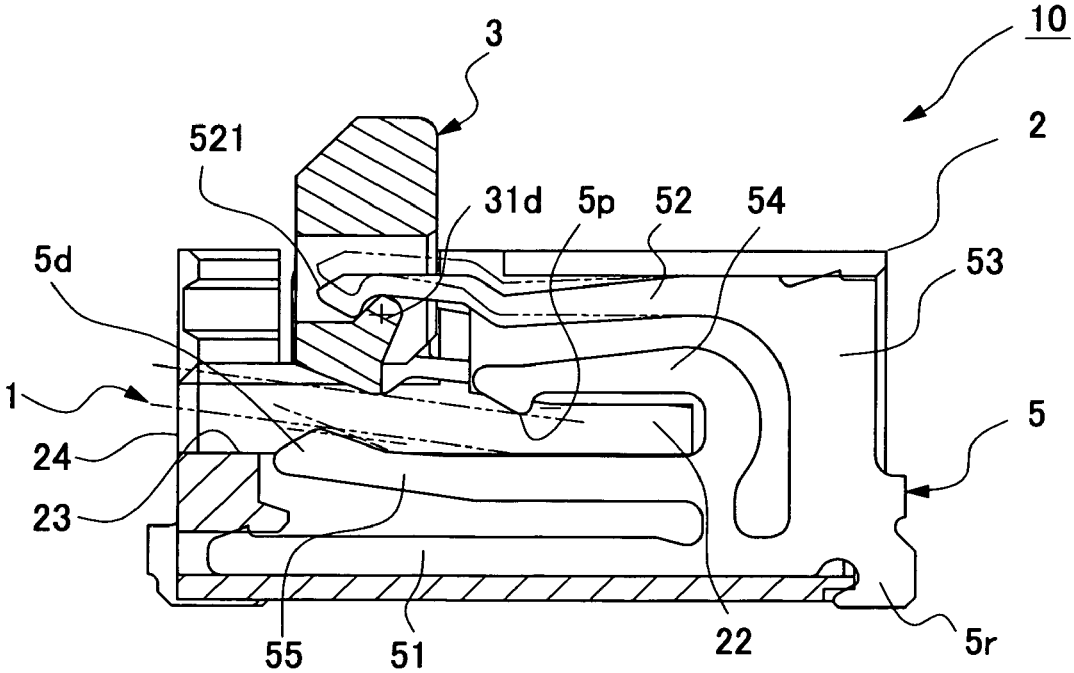
FIG. 6 shows a longitudinal sectional view in which the side surface of the second contact of a connector for FPC according to the present embodiment is cross-sectionally shown, in a state where the cover housing is open.
Figure 7:
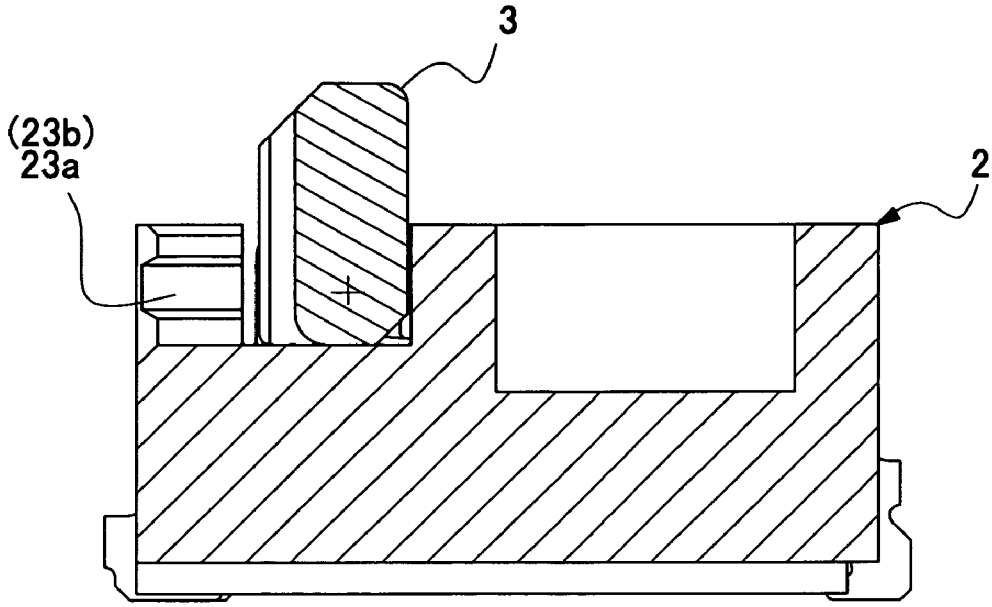
FIG. 7 shows a longitudinal sectional view, taken on line Y-Y of FIG. 4, of a connector for FPC according to the present invention.
Figure 8:
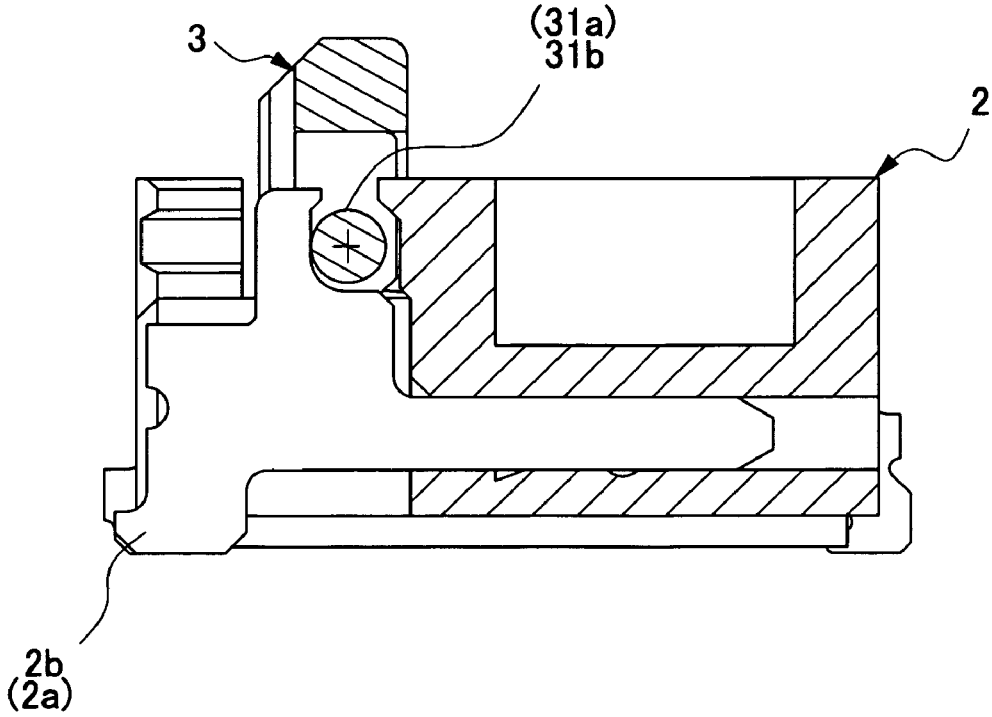
FIG. 8 shows a longitudinal sectional view, taken on line Z-Z of FIG. 4, of a connector for FPC according to the present invention.

FIG. 5 is a longitudinal sectional view (a longitudinal sectional view taken on line W-W of FIG. 4) in which the side surface of the first contact of a connector according to the present embodiment is cross-sectionally shown, in a state where the cover housing is open. FIG. 6 is a longitudinal sectional view taken on line X-X of FIG. 4 in which the side surface of the second contact of a connector according to the present embodiment is cross-sectionally shown, in a state where the cover housing is open. FIG. 7 is a longitudinal sectional view, taken on line Y-Y of FIG. 4, of a connector according to the present invention. FIG. 8 is a longitudinal sectional view, taken on line Z-Z of FIG. 4, of a connector according to the present invention.

Figure 9:
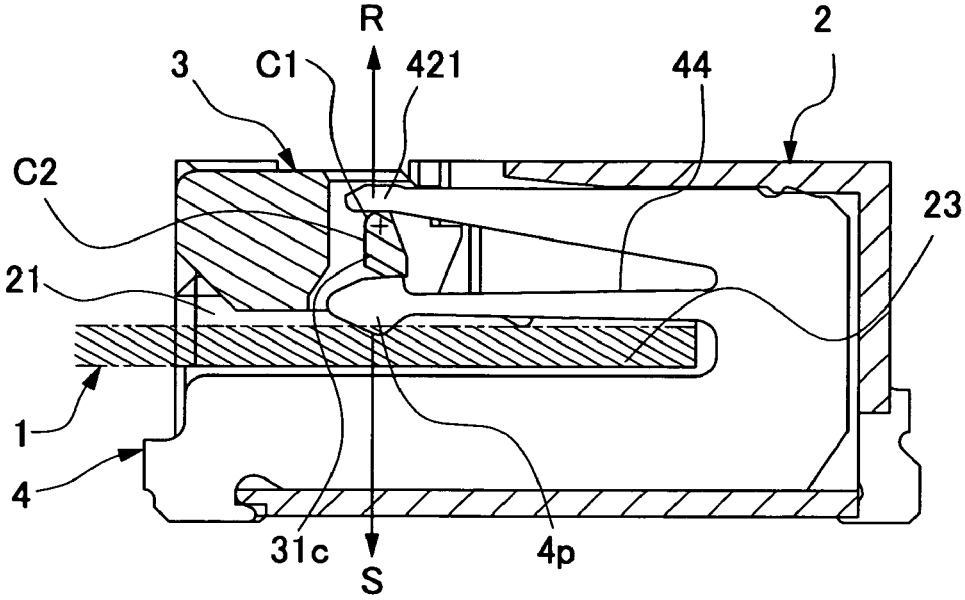
FIG. 9 shows a longitudinal sectional view in which the side surface of the first contact of a connector for FPC according to the present embodiment is cross-sectionally shown, in a state where the cover housing is closed.
Figure 10:
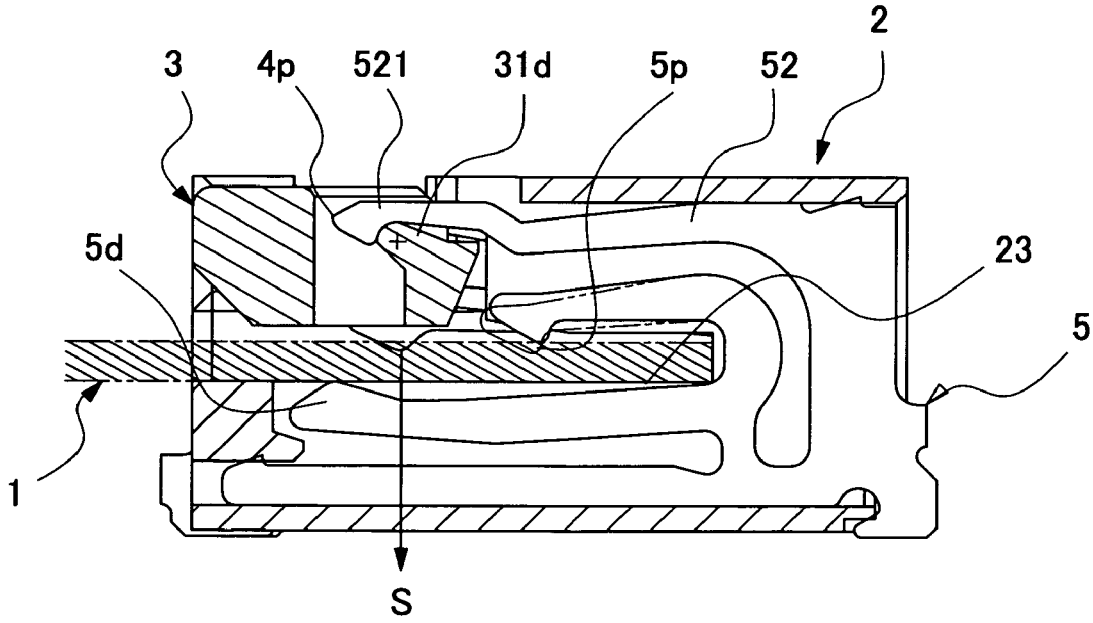
FIG. 10 shows a longitudinal sectional view in which the side surface of the second contact of a connector for FPC according to the present embodiment is cross-sectionally shown, in a state where the cover housing is closed.
Figure 11:
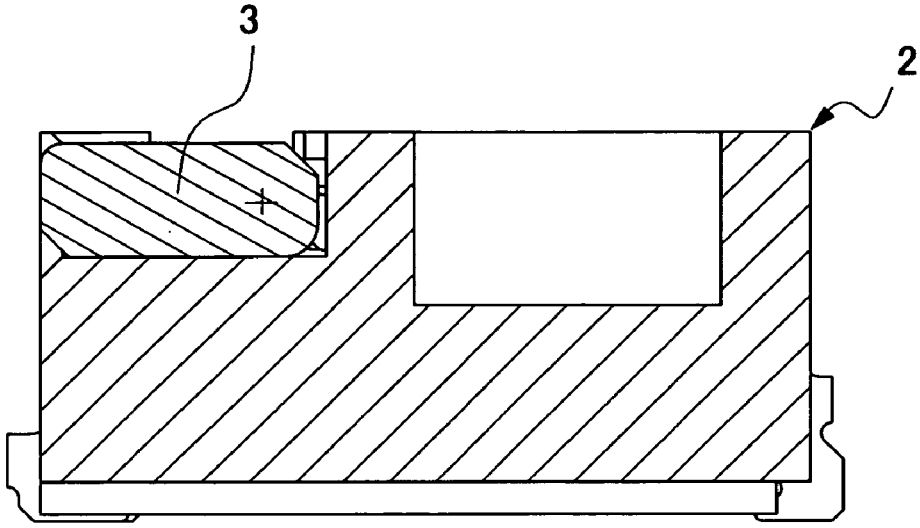
FIG. 11 shows a longitudinal sectional view, taken on line Y-Y of FIG. 4, of a connector for FPC according to the present invention.
Figure 12:
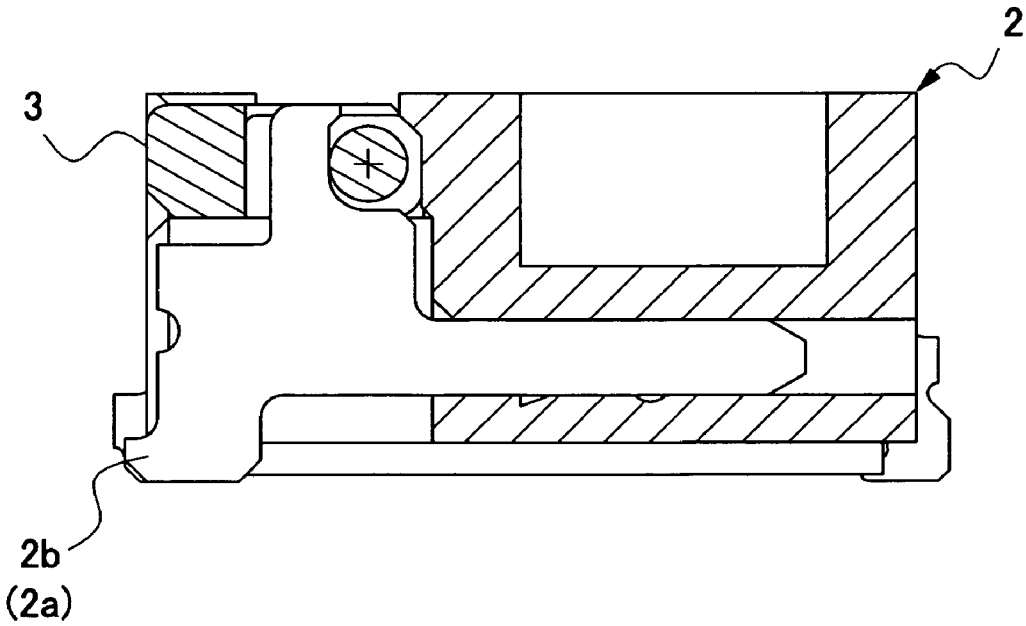
FIG. 12 shows a longitudinal sectional view, taken on line Z-Z of FIG. 4, of a connector for FPC according to the present invention.
Figure 13:
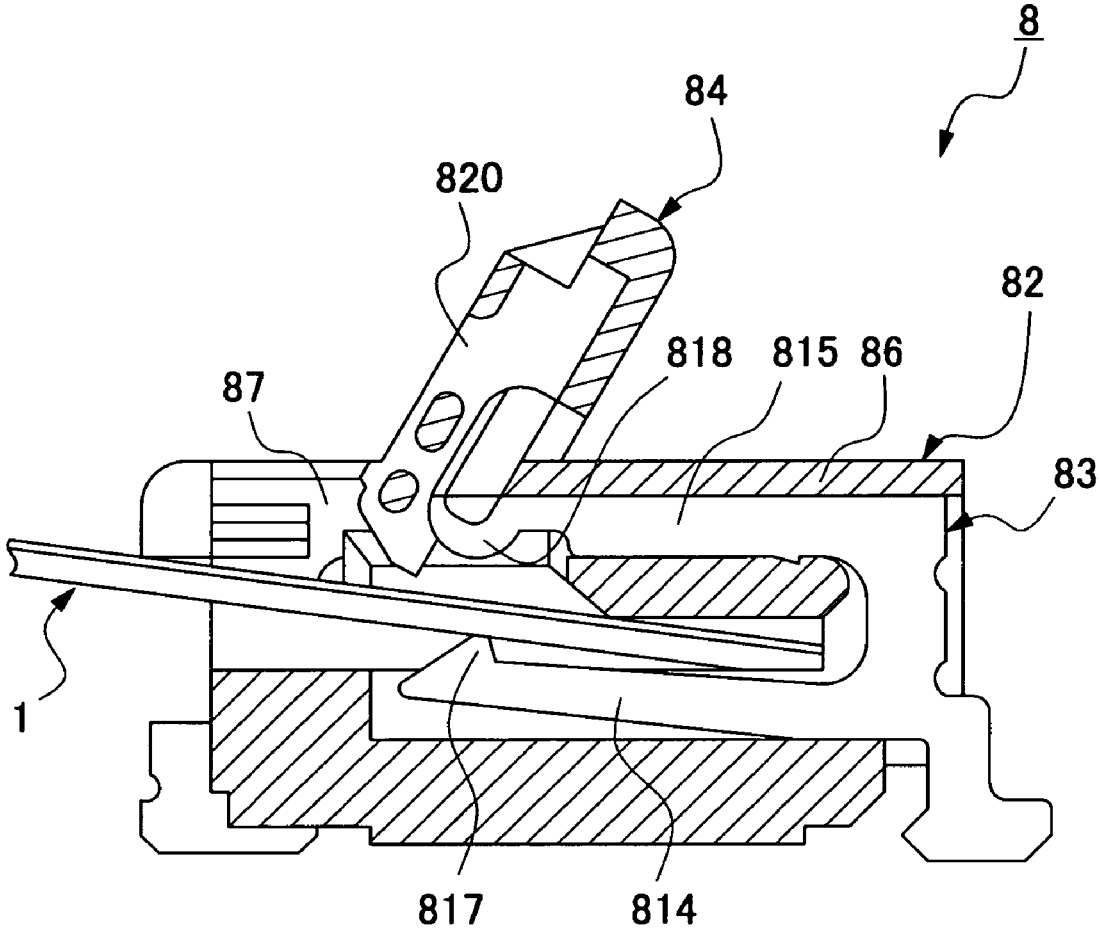
FIG. 13 shows a longitudinal sectional view of a connector for an FPC of the conventional art in a state where FPC is inserted with the cover housing kept open.
Figure 14A:
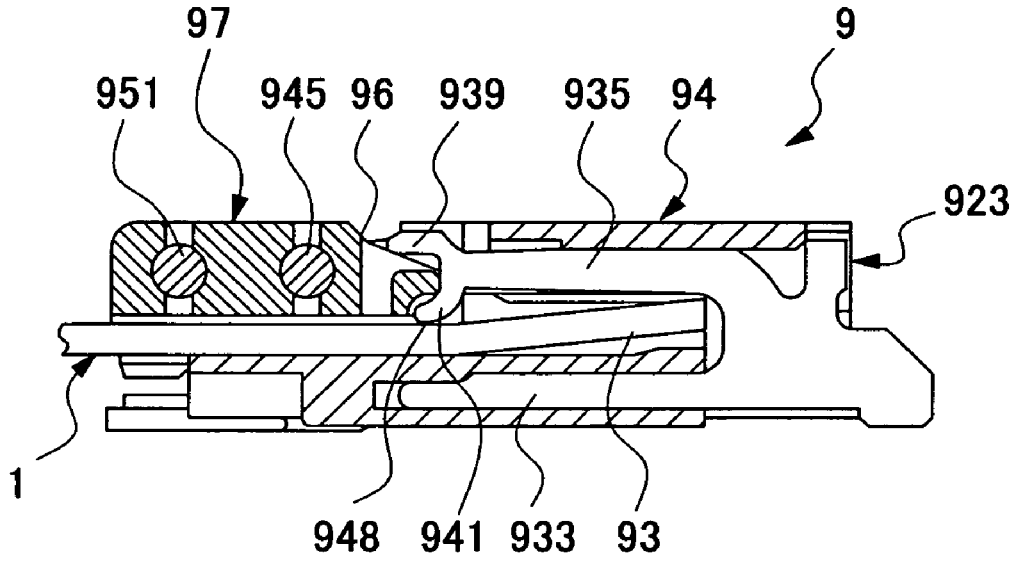
FIG. 14A shows a longitudinal sectional view of a connector for an FPC of the conventional art, which illustrates the whole connector.
Figure 14B:
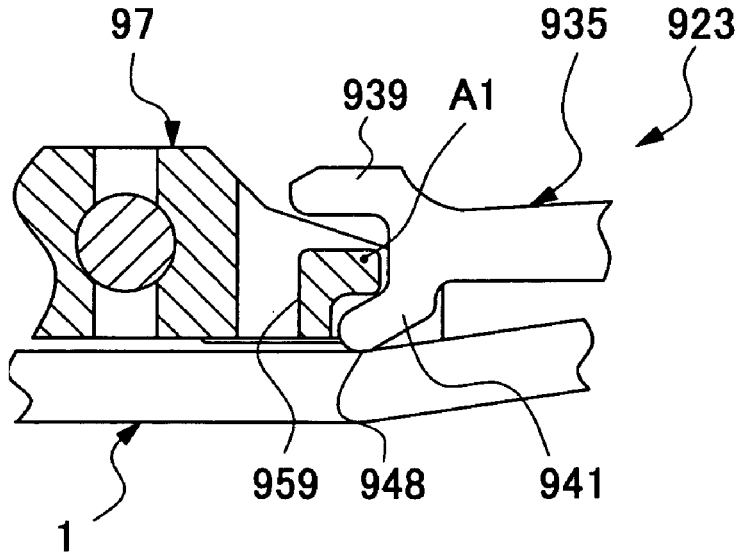
PRIOR ART FIG. 14B
FIG. 14B shows a longitudinal sectional view of a connector for the FPC of the conventional art, which illustrates an enlarged principal part of FIG. 14A.

FIG. 9 is a longitudinal sectional view taken on line W-W of FIG. 4 in which the side surface of the first contact of a connector according to the present embodiment is cross-sectionally shown, in a state where the cover housing is closed. FIG. 10 is a longitudinal sectional view taken on line X-X of FIG. 4 in which the side surface of the second contact of a connector according to the present embodiment is cross-sectionally shown, in a state where the cover housing is closed. FIG. 11 is a longitudinal sectional view, taken on line Y-Y of FIG. 4, of a connector according to the present invention. FIG. 12 is a longitudinal sectional view, taken on line Z-Z of FIG. 4, of a connector according to the present invention.

First, the configuration of the connector according to the present invention is described. As shown in FIG. 1, the connector 10 is a connector that is conductively connected with the FPC 1 inserted in the recess 21 and includes the insulative housing 2. The housing 2 has a recess 21 for insertion of the FPC 1. One end of the recess 21 is open and the other end of the recess 21 is formed with an insertion portion 22 against which one end 11 of FPC 1 abuts. The plurality of first and second contacts 4, 5 have an alternately parallel arrangement aligned in a line inside the housing. The plurality of first and second contacts 4, 5 are conductively connected with the FPC 1.

As shown in FIG. 1, the housing 2 is molded out of an insulating synthetic resin made from non-conducting material. The housing 2 is formed in a roughly rectangular parallelepiped shape with a thin rectangular-parallelepiped shaped recess 21 for insertion of the FPC 1. The FPC 1 is inserted from the opening portion 24 side of the recess 21 toward the insertion portion 22.

Upon insertion of the FPC 1 into the recess 21, a pair of opposing vertically-arranged walls 21*a*, 21*b* (refer to FIG. 2) forming the recess 21 guides the width direction of the FPC 1, and aligns the walls with the plurality of first and second contacts 4, 5. The plurality of first and second contacts 4, 5 arranged in the housing 2 are then conductively connected to the FPC 1.

As shown in FIG. 5 or FIG. 6, the insertion portion 22 has a width slightly larger than the thickness of the FPC 1, and has a slope formed on a surface opposing the bottom surface 23 of the recess 21 in such a way that the FPC 1 can be inserted in a slanted position at a predetermined open angle from the bottom surface 23 of the recess 21. The connector 10 is a ZIF connector which requires little force to insert and remove FPC 1 into or out of the insertion portion.

As shown in FIG. 1, the connector 10 includes a roughly rectangular shaped cover housing 3. The cover housing 3 is molded out of insulative synthetic resin made from non-insulative material. One end of the cover housing 3 is provided with a pivot shaft 31 of which ends are pivotally supported by the housing 2 (refer to FIG. 2). The other end of the cover housing 3 opens and closes the recess 21. The cover housing 3 opens to allow the FPC 1 to be inserted into the insertion portion 22.

As shown in FIG. 2, the cover housing 3 includes a pair of cylindrical protrusions 31*a*, 31*b* which are coaxial to the pivot shaft 31 on both sides of one end. The pair of cylindrical protrusions 31*a*, 31*b* is pivotally supported by the housing 2 on both ends. More specifically, a pair of tabs 2*a*, 2*b* to be pressed into the housing 2 pivotally support the pair of cylindrical protrusions 31*a*, 31*b*. The pair of tabs 2*a*, 2*b* complements the connection strength of the connector 10 to a printed circuit board (not shown) by pressing into the housing 2 and soldering to the printed circuit board.

Closing of the cover housing 3 presses the FPC 1 inserted into the insertion portion 22 and is made to abut against the plurality of the first and second contacts 4, 5 (refer to FIGS. 9 and 10). A locking mechanism is provided to maintain a closed position of the cover housing 3 upon the closing of the cover housing 3. The locking mechanism will be described later.

As shown in FIG. 1 or 2, the connector 10 includes a plurality of first contacts 4. As shown in FIG. 5, each of the first contacts 4 includes a fixing arm 41 and a horizontal arm 42 opposing each other. The first contact 4 includes a connection leg 43 for connecting the base ends of the fixing arm 41 and the horizontal arm 42 to each other. Moreover, the first contact 4 includes an elastic arm 44 which extends between the fixing arm 41 and the horizontal arm 42 and opposes the horizontal arm 42.

As shown in FIG. 1, the housing 2 includes a plurality of longitudinal rectangular grooves in a comb-teeth shape from the opening 24 side of the recess 21 to the insertion portion 22 and further to the rear of the insertion portion 22. The first contact 4 is pressed into the housing 2 from the recess 21 side (refer to FIG. 5). The housing 2 is formed with longitudinal rectangular grooves in a comb-teeth shape which run to the opening 24 side from the opposite side to the opening 24 of the recess 21. The second contact 5 is pressed into the housing 2 from the opposite side of recess 21 (refer to FIG. 6).

The longitudinal rectangular groove has a width slightly larger than the plate thicknesses of the first contact 4 and the second contact 5 so that the elastic arm 44, and a short arm and a long arm described later can be deflected. The first contact and the second contact may have an equal plate thickness, and the longitudinal rectangular grooves also have an equal width. The first contact 4 and the second contact 5 is pressed into the housing so as to come into contact with the top surface and the bottom surface of the recess of the housing.

As shown in FIG. 5, the first contact 4 includes a connection leg 43 with the base end of the fixing arm 41 standingly provided, and the horizontal arm 42 is extendedly branched toward the opening 24 side of the recess 21 from the connection leg 43. Moreover, the pressing portion opposing the bottom surface of the recess is provided on the tip side of the horizontal arm. The horizontal arm 42 is a rigid arm with a larger geometrical moment of inertia than that of the horizontal arm 52 of the second contact. The elastic arm 44 is extendedly branched from the connection leg 43 between the fixing arm 41 and the horizontal arm 42. The elastic arm 44 has a first contact point 4*p* on the tip side, facing downwards, opposing the bottom surface 23 of the recess 21 on the tip side, and the FPC 1 is inserted in between the first contact point 4*p* and the fixing arm 41 in the bottom surface 23 of the recess 21 (refer to FIG. 1). The first contact point 4*p* is positioned on the opening 24 side of the recess 21 nearer than a second contact point 5*p* described later.

As shown in FIG. 1 or 2, the connector 10 includes a plurality of second contacts 4. As shown in FIG. 6, each of the second contacts 4 includes a fixing arm 51 and a horizontal arm 52 opposing each other. The second contact 5 has a connection leg 53, which connects the base ends of the fixing arm 51 and the horizontal arm 52. The second contact 5 includes a short arm 54 and a long arm 55 extending to between the fixing arm 51 and the horizontal arm 52 and opposing each other. The second contact 5 includes a connection portion 56 which connects the base ends of the short arm 54 and the long arm 55 each other.

The second contact 5 includes the connection leg 53 with the base end of the fixing arm 51 standingly provided, and the horizontal arm 52 is extendedly branched from the connection leg 53 toward the opening 24 side of the recess 21. Furthermore, the second contact 5 includes a pressing portion 521 opposing the long arm 55 in the bottom surface 23 of the recess 21 on the tip side of the horizontal arm 52. The horizontal arm 52 includes an elastic arm with a smaller geometrical moment of inertia than that of the horizontal arm 42.

The short arm 54 and the long arm 55 opposing each other extend between the fixing arm 51 and the horizontal arm 52. The short arm 54 has a second contact point 5*p* facing downwards, opposing the bottom surface 23 of the recess 21 and positioned away from the opening 24 of the recess 21. The FPC 1 is inserted between the second contact point 5*p* and the long arm 55 in the bottom surface 23 of the recess 21. The long arm 55 includes a protrusion 5*d* protruding upwards and positioned near the opening 24 of the recess 21.

As shown in FIG. 6, the length from the base end to the tip of the short arm 54 is shorter than that of the long arm 55 and the base ends of the short arm 54 and the long arm 55 are connected to each other through a connecting portion 56, thereby providing a constitution of a tuning-fork-shaped contact having an uneven length constituting the pair of the short arm 54 and the long arm 55. As shown in FIG. 6, the second contact point 5*p* and the protrusion 5*d* are spaced at a predetermined interval, and FPC 1 is inserted in between the second contact point 5*p* and the protrusion 5*d*. The protrusion 5*d* is biased to push up the FPC 1. In this embodiment as shown in FIG. 6, the base ends of the short arm 54 and the long arm 55 are connected to each other at the connecting portion 56. The base end side of the long arm 55 in the connecting portion standingly extends to the fixing arm 51.

As shown in FIG. 1 or 2, the cover housing 3 includes a cam portion 31*c* and an engaging portion 31*d*. The cam portion 31*c* is positioned between a pressing portion 421 of the first contact 4 and the tip side of the elastic arm 44 and is pressed by the pressing portion 421 of the first contact 4 (refer to FIG. 5). The engaging portion 31*d* is positioned between the pressing portion 521 of the second contact 5 and the bottom surface 23 of the recess 21 and engages with the pressing portion 521 of the second contact 5 (refer to FIG. 6).

As shown in FIG. 5, the cam portion 31*c*, formed around the pivot shaft 31 (refer to FIG. 2), is a plate cam having a plane curve as its contour. The cam portion 31*c* is an eccentric cam having a portion of the contour deviated from the center axis of the pivot shaft 31. Moreover, the tip side of the elastic arm 44 is a follower displaced by a pivotal movement of the cam portion 31*c*.

As shown in FIG. 5, the cam portion 31*c* includes a first contour portion C1 and a second contour portion C2 continuous with the first contour C1. As shown in FIG. 9, when the first contour portion C1 abuts against the pressing portion 421 of the first contact 4, the cam portion 31*c* is biased by a strong force from the tip side of the elastic arm 44 to keep the cover housing 3 closed. On the other hand, when the second contour portion C2 abuts against the pressing portion 421 of the first contact 4 as shown in FIG. 5, the cam portion 31*c* is biased by a weak force from the tip side of the elastic arm to keep the cover housing 3 open.

As shown in FIG. 3 or FIG. 4, the housing 2 includes the first contacts 4 and the second contacts 5 which have an alternately parallel arrangement aligned in a line therein. The plurality of first and second contacts 4, 5 are arranged at equal intervals to those of the conductive patterns, exposed on one end 11 of FPC 1, as upper contact points in the FPC 1 (refer to FIG. 1). As shown in FIG. 1, the plurality of first contacts 4 and the plurality of second contacts 5 come into contact with the conductive patterns (upper contact points) exposed on one surface of the FPC 1.

As shown in FIG. 5, the first contact 4 includes a first lead portion 4*r* extending in the non-insertion direction of the FPC 1 from the opening 24 side of the recessed portion 21. As shown in FIG. 6, the second contact 5 includes a second lead portion 5*r* extending in the insertion direction of the FPC 1 from the opposite side to the recessed portion 21. The bottom surface of each of the first and second lead portions 4*r*, 5*r* is soldered to a printed circuit board (not shown refer to FIG. 1).

The connector 10 provides a connector for a printed circuit board surface-mounted onto the printed circuit board by soldering the plurality of first and second lead portions 4*r*, 5*r* to the printed circuit board. The first lead portion 4*r* and the second lead portion 5*r* are disposed in opposite directions, therefore the pitch between the patterns connected to the first and second lead portions can be increased more than those of the first and second lead portions 4*r*, 5*r* extending in one direction. This connector is effective, especially, for the case that the pitch of the contacts is small or approximately 0.3 mm.

A configuration of the afore-mentioned lock mechanism will now be described. As shown in FIG. 2, a pair of protrusions 33*a*, 33*b* protrude in such a direction as to oppose both sides of the cover housing 3. A pair of recesses 23*a*, 23*b* fitted onto the pair of protrusions 33*a*, 33*b* is formed in an internal wall surface of the opening side of the housing 2 in an opposing way.

As shown in FIGS. 5 to 8, when the cover housing 3 is pivoted from an opened position, the pair of protrusions 33*a*, 33*b* pushes the pair of recesses 23*a*, 23*b* to be deformed widely. The pair of protrusions 33*a*, 33*b* then fits into the pair of recesses 23*a*, 23*b* to lock the cover housing 3 in a closed position (refer to FIGS. 9 to 11). The cover housing 3 is opened when a strong force that pushes the pair of recesses 23*a*, 23*b* widely deformed is made to act, thereby releasing the locking position of the cover housing 3.

With reference to the drawings, an action of the connector according to the present invention will be described.

As shown in FIG. 5, the pressing portion 421 of the tip side of the horizontal arm 42 is made to abut against the second contour portion C2 of the cam portion 31*c* to keep the cover housing 3 in an open position. The tip side of the elastic arm 44 energizes the cam portion 31*c* with a weak force to assist an opening position of the cover housing 3. The FPC 1 is inserted between the first contact point 4*p* and the fixing arm 41 (refer to FIG. 5) and between the second contact point 5*p* and the protrusion 5*d* (refer to FIG. 6).

Next, pivoting the cover housing 3 counter-clockwise gives rise to the states shown in FIGS. 9 to 12. As shown in FIG. 9, when the first contour portion C1 abuts against the pressing portion 421 of the first contact 4, the cam portion 31*c* is biased by a strong force from the tip side of the elastic arm 44 to keep the cover housing 3 closed.

When the FPC 1 is inserted into the recess 21 and the cover housing 3 is closed, the cam portion 31*c* pivots, so that the tip side of the elastic arm 44 is displaced, and the plurality of first contact points 4*p* come into contact with the conductive pattern of the FPC 1 for electrical continuity (refer to FIG. 9). Closing the cover housing 3 allows the plurality of second contact points 5*p* to come into contact with the conductive pattern of the FPC 1 for electrical continuity.

As shown in FIG. 10, closing the cover housing 3 allows the plurality of first contact points 4*p* to push down the FPC 1 to the bottom surface 23 side of the recess 21. The plurality of protrusions 5*d* protruding from the long arm 55 are pushed down to the bottom surface 23 side of the recess 21. Here, the short arm 54 and the long arm 55 become integrated into one body, which pivots with the base ends of the short arm 54 and the long arm 55 as the pivotal center thereof. That is, the tuning-fork-shaped contact having the pair of the short arm 54 and the long arm 55 works so as to exert a coupled force on the FPC 1. The plurality of second contact points 5*p* generates a coupled force opposing to one end of the FPC 1. The plurality of second contact points 5*p* come into contact with the conductive pattern of the FPC 1, thus enabling electrical continuity.

As shown in FIG. 9, when the cover housing 3 is closed, a uniformly distributed load to be separated from the bottom surface 23 of the recess 21 is made to work on the cover housing 3 by a reaction R of the tip side of the elastic arm 44. In other words, a force which generates curving so as to separate from the bottom surface 23 of the recess 21 is made to work on the cover housing 3. The pressing portions 421, 521 of the plurality of first and second contacts 4, 5 exert a force moving toward the bottom surface 23 of the recess 21 to the cam portion 31*c* and the engaging portion 31*d* so as to resist a uniformly distributed load separated from the bottom surface 23 of the recess 21.

A connector in the conventional art has a proportional relationship to the number of contacts, and applies a proportional force for deforming a cover housing. Accordingly, a multi-pin connector has an integrally-formed metal member for reinforcement to prevent deformation of the cover housing. On the other hand, the connector according to the present invention described above receives little force for deforming a cover housing from the second contact. In other words, it can be said that the force of deforming the cover housing is half the number of contacts. A well-balanced design of the reaction of the elastic arm and the drag of the pressing portion of the second contact can allow the cover housing to bea molded product made of synthetic resin alone.

For example, the number of poles of the contacts in the connector according to this embodiment a shown in FIGS. 1 to 4 is 21 and the contact pitch is 0.3 mm. In addition, a connector is also attainable, of which number of poles of the contact is 51 and contact pitch is 0.3 mm. As described above, the present invention, a connector for an FPC of an upper contact type with a small pitch, provides a connector for an FPC having a structure capable of performing complete switching without deforming the cover housing made of synthetic resin alone.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A connector comprising a housing, a cover housing and a plurality of first contacts and second contacts, the housing being roughly rectangular parallelepiped in shape and having a recess formed for insertion of an FPC, the cover housing being roughly rectangular in shape for openably and closably covering the recess of the housing and the first contacts and second contacts being alternately arranged in parallel on a line inside the housing, wherein:

each of the first contacts comprises: a first fixing arm and a first horizontal arm opposing each other; a first connection leg for connecting base ends of the first fixing arm and the first horizontal arm to each other; a first pressing portion provided on a tip side of the first horizontal arm and opposing a bottom surface of the recess; an elastic arm extending between the first fixing arm and the first horizontal arm and opposing the first horizontal arm; and a first contact point provided on a tip side of the elastic arm and opposing the bottom surface of the recess;

each of the second contacts comprises: a second fixing arm and a second horizontal arm opposing each other; a second connection leg for connecting base ends of the second fixing arm and the second horizontal arm to each other; a second pressing portion provided on a tip side of the second horizontal arm and opposing the bottom surface of the recess; a short arm and a long arm extending between the second fixing arm and the second horizontal arm and opposing each other; a second contact point provided on a tip side of the short arm and positioned near the opposite side to an opening in the recess opposing the bottom surface of the recess; and a protrusion provided on a tip side of the long arm and positioned near the opening in the recess, protruding toward the direction of a top face of the recess; and the cover housing comprises: a cam portion positioned between the first pressing portion and the tip of the elastic arm and pressed by the first pressing portion; and an engaging portion positioned between the second pressing portion and the bottom surface of the recess and engaging with the second pressing portion.

2. A connector according to claim 1, wherein the first contact includes a first lead portion extending in a non-insertion direction of the FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

3. A connector according to claim 1, wherein the first horizontal arm is a rigid arm having a larger geometrical moment of inertia than the second horizontal arm.

4. A connector according to claim 3, wherein the cam portion comprises a first contour portion for maintaining a closing position of the cover housing, and a second contour portion which is continuous to the first contour portion and maintains an open position of the cover housing, the cam portion biases the first contact point to the FPC when the first pressing portion engages with the second contour portion.

5. A connector according to claim 3, wherein the first contact point is positioned nearer to the opening side of the recess than the second contact point.

6. A connector according to claim 3, wherein a base end of the short arm and a base end of the long arm are connected to each other and the base end of the long arm is standingly extended from the second fixing arm.

7. A connector according to claim 3, wherein the first contact includes a first lead portion extending in a non-insertion direction of the FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

8. A connector according to claim 1, wherein the cam portion comprises a first contour portion for maintaining a closed position of the cover housing, and a second contour portion which is continuous to the first contour portion and maintains an open position of the cover housing, the cam portion biases the first contact point to the FPC when the first pressing portion engages with the second contour portion.

9. A connector according to claim 8, wherein the first contact point is positioned nearer to the opening side of the recess than the second contact point.

10. A connector according to claim 8, wherein a base end of the short arm and a base end of the long arm are connected to each other and the base end of the long arm is standingly extended from the second fixing arm.

11. A connector according to claim 8, wherein the first contact includes a first lead portion extending in a non-insertion direction of the FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

12. A connector according to claim 1, wherein the first contact point is positioned nearer to the opening side of the recess than the second contact point.

13. A connector according to claim 12, wherein a base end of the short arm and a base end of the long arm are connected to each other and the base end of the long arm is standingly extended from the second fixing arm.

14. A connector according to claim 12, wherein the first contact includes a first lead portion extending in a non-insertion direction of the FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

15. A connector according to claim 1, wherein a base end of the short arm and a base end of the long arm are connected to each other and the base end of the long arm is standingly extended from the second fixing arm.

16. A connector according to claim 15, wherein the first contact includes a first lead portion extending in a non-insertion direction of the FPC from the opening side of the recess, the second contact includes a second lead portion extending in an insertion direction of the FPC from the opening side of the recess, and a bottom surface of the first lead portion and a bottom surface of the second lead portion are soldered to a printed circuit board.

* * * * *